US007137629B2

(12) United States Patent
Chapman

(10) Patent No.: US 7,137,629 B2
(45) Date of Patent: Nov. 21, 2006

(54) CARD GAMES

(76) Inventor: Anthony R. Chapman, 23 Queen Mary Avenue, Camberley, Surrey (GB) GU15 3BL ( * ) Notice: Subject to any disclaimer, the term of this patent is extended or adjusted under 35 U.S.C. 154(b) by 0 days.

(21) Appl. No.: 10/502,032

(22) PCT Filed: Jul. 31, 2002

(86) PCT No.: PCT/GB02/03555

§ 371 (c)(1),
(2), (4) Date: Jul. 21, 2004

(87) PCT Pub. No.: WO03/061789

PCT Pub. Date: Jul. 31, 2003

(65) Prior Publication Data

US 2005/0073099 A1 Apr. 7, 2005

(30) Foreign Application Priority Data

Jan. 22, 2002 (GB) ..... 0201371.2

(51) Int. Cl.
*A63F 1/00* (2006.01)

(52) U.S. Cl. ..... 273/292; 463/17

(58) Field of Classification Search ..... 273/292, 273/309, 274, 250–299; 463/12, 13, 17; 274/292, 274, 309
See application file for complete search history.

(56) References Cited

U.S. PATENT DOCUMENTS

| | | | | |
|---|---|---|---|---|
| 5,159,549 | A | 10/1992 | Hallman et al. | |
| 5,320,356 | A | 6/1994 | Cauda | |
| 5,813,673 | A * | 9/1998 | Richardson | 273/292 |
| 5,851,011 | A * | 12/1998 | Lott | 273/292 |
| 6,004,205 | A * | 12/1999 | Lauretta et al. | 463/11 |
| 6,234,483 | B1 * | 5/2001 | Bucan | 273/292 |
| 6,234,485 | B1 | 5/2001 | Perkins | |
| 6,299,170 | B1 | 10/2001 | Voseloff | |
| 6,302,396 | B1 | 10/2001 | Eaton et al. | |

* cited by examiner

*Primary Examiner*—Benjamin Layno
(74) *Attorney, Agent, or Firm*—Lowe, Hauptman & Berner, LLP

(57) ABSTRACT

A gambling card game played in three main stages: initial betting and dealing, bet adjustment, and band checking and payouts. In the first stage, each player places an initial bet and is dealt a three-card hand, and the dealer is dealt a single card. In the second stage, each player increases his initial bet by a multiple (within predetermined limits) chosen by the player in dependence on the hand dealt him. A player can also place a Bonus bet if his hand is all court cards. In the third stage, the dealer pays out on bets on hands for which any card in the hand matches the dealer's card in suit and exceeds it in value, and also on Bonus belts (at the same odds) for winning hands.

9 Claims, 2 Drawing Sheets

CARD GAMES

FIELD OF THE INVENTION

The present invention relates to card games, and more specifically to gambling card games and apparatus for playing them.

BACKGROUND OF THE INVENTION

There is a wide variety of gambling card games. In some, all participants are on an essentially equal footing; others are of the casino type in which there is a dealer or "house" which operates the game and against which the players play. The present invention is concerned with the latter type of game (although, of course, it may be agreed that different players can become dealer as the session progresses).

Different types of games can involve different degrees of complexity and skill. It is desirable for a game to have the right degree of complexity; if it is too complex then many potential players will be put off, whereas if it is too simple, then potential players will soon lose interest. The same applies to skill; if little or no skill is involved (eg simply cutting for the highest card for fixed stakes) then potential players will soon lose interest, whereas if it appears to demand a high level of skill, then many potential players will be put off.

The object of the present invention is to provide a game which is novel and attractive (ie involves intermediate levels of complexity and skill).

SUMMARY OF THE INVENTION

According to the invention there is provided a casino-type card game, the main features of which area as follows.

The game is played with a standard pack of playing cards.

Each player is dealt a hand of a fixed number of cards, preferably 3, and the dealer is dealt a single card.

Each player places an initial bet and then increases it by a multiple (within predetermined limits) chosen by the player in dependence on the hand dealt to the player.

A hand wins if any card in it matches the dealer's card in suit and exceeds it in value.

The dealer's card is discarded if it is above a certain value and another card dealt.

The number of players is variable, from one (apart from the dealer) up to the number of player positions on the playing surface. Partnerships between players are not allowed, and each player may play only one hand.

According to another aspect of the invention there is provided apparatus for playing a casino-type card game comprising a playing table having a dealer position and a plurality of player positions arranged around the dealer position, each player position having an ANTE box or area, and there being a plurality of arcs around the dealer position, each arc passing through all the player positions, and the arcs being labelled with successive multipliers.

DETAILED DESCRIPTION OF PREFERRED EMBODIMENTS

Brief Description of the Drawings

A game embodying the invention will now be described in detail, by way of example and with reference to the drawings, in which:

Referring to FIG. 1, the game is played at a table or playing surface 10 having a dealer position 11 and a plurality of player positions 12 suitably marked, either directly on the table top or on a cloth laid over the table top. The various positions are suitably marked to define various area discussed below, with the player positions 12 being laid out in an arc around the dealer position 11. The table is preferably approximately D shaped, with the dealer position at the middle of the vertical line of the D and the player positions spaced around the curve of the D facing the dealer.

For each player position, the table has marked on it a respective box or location 21 which has the word "ANTE" in it and a similar box or location 21 which has the word "BONUS" in it. In addition, the table has a set of 5 arcs 20 laid out on it parallel to the curved edge of the D. These arcs are marked with the symbols "x5", "x4", "x3", "x2", and "x1" as shown. The markings are repeated at intervals along the arcs, between the player positions 12, as shown.

Figure 1:
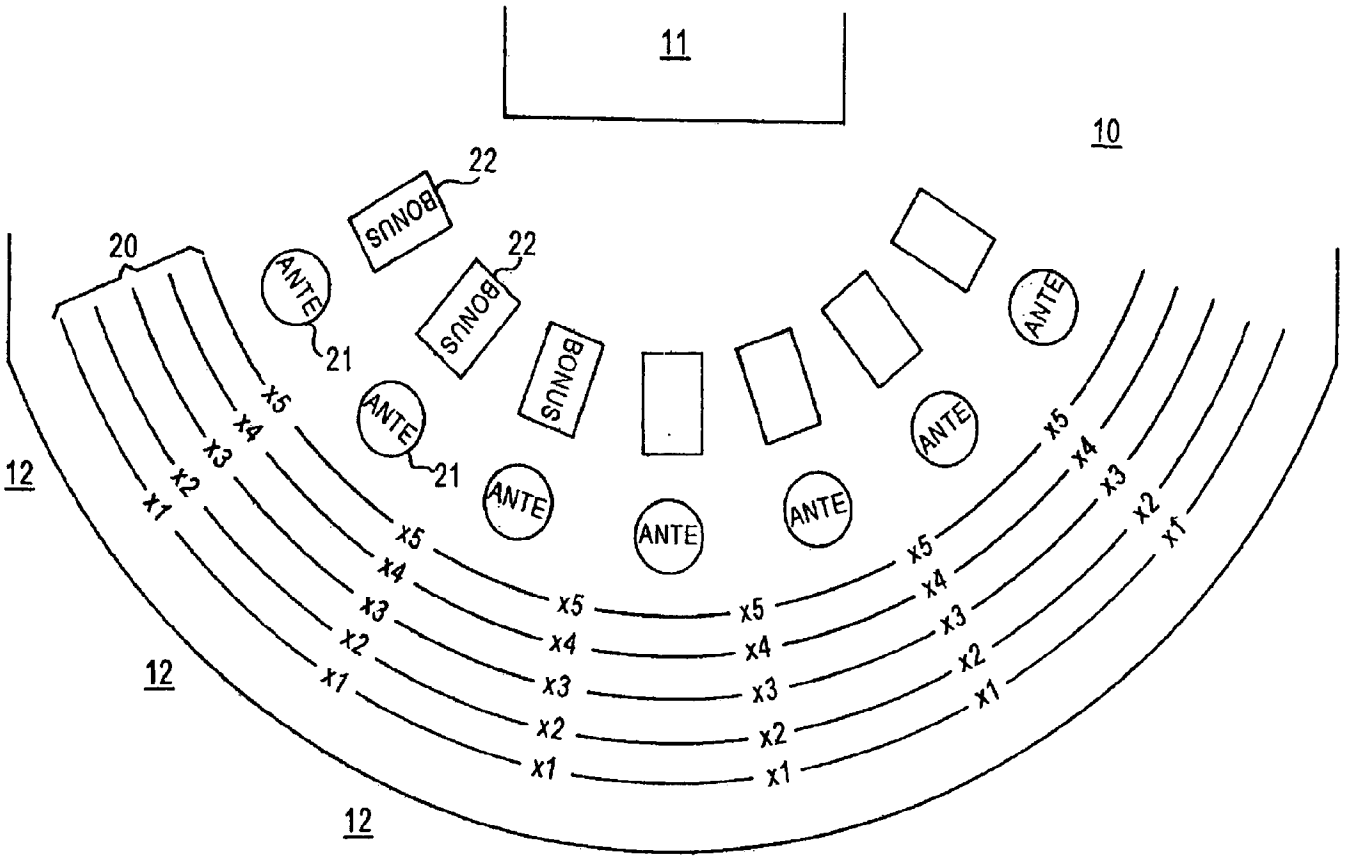
FIG. 1 shows the playing table.
Figure 1A:
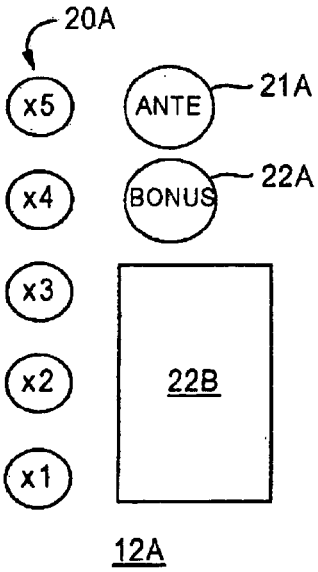
FIG. 1A shows a modification of a player position.

FIG. 1A shows a modified form of player position 12A. There are 5 positions 20A corresponding to the arcs 20 and an ANTE position 21A. In addition, there is a BONUS position 22A which serves only for placing Bonus bets, the cards being placed on a card position 22B.

To play the game, each player chooses an initial stake and places that stake in their ANTE box. The dealer then deals out a hand of 3 cards to each player, placing the cards in the BONUS box 22. Each player then inspects their hand and decides how much to bet as a Raise bet. The Raise bet has to be a multiple of between 1 and 5 times the player's original stake, and the player makes the bet by placing the appropriate multiple of the original stake on the chosen line 20 (leaving the original stake in the ANTE box). If the player decides to throw in their hand, they lose their initial stake. In addition, if all the player's cards are court cards (A, K, Q, and J), they can place a Bonus bet, of up to 10 times their Ante bet. The Bonus bet is placed in their BONUS box 22. The Bonus box may be identified by a name having suitably positive connotations, such as "Kaboom", which may also be used as the name of bonus hands and the game.

When all players have made their bets, the dealer deals a single dealer's card. If the dealer's card is a court card, it is discarded and the dealer deals another card, until the dealers card is 10 or below. Each player then compares their hand with the dealer's card. A player wins if they have a card with the same suit as the dealer's card and of higher value. The card values are defined as A (ace, highest), followed by K, Q, etc, down to 2 (lowest). If the player has made a BONUS bet and has a winning hand, then they are also paid out on the Bonus bet at the same odds (ie as defined by the line 20 they have chosen for their Raise bet).

As an example, suppose that a player has staked £5 in the ANTE box, and is dealt a hand consisting of the 8 of clubs, the Q of diamonds, and the J of clubs. The player has to increase their bet by a multiple of between 1 and 5; suppose that the player likes the fact that their cards are generally high, and therefore chooses to increase their stake by the maximum multiple of 5. The player therefore places £25 on the "x5" line 20. Suppose then that the dealer's card, ie the card exposed by the dealer, is the 9 of diamonds. When the player exposes their hand, the 8 of clubs and the J of clubs are losing cards, since they are not diamonds (the suit of the dealer's card). The Q of diamonds, however, is of the same suit as the dealer's card and is of higher rank (Q is higher than 9). The player has therefore won, and is paid £30 (ie the original stake plus the chosen multiple, x5, the original stake). The player also retains all their stake money.

It will of course be realized that many of the specific features of the game may be varied. Thus the number of cards dealt to the players may be varied, the number of allowed multiples of the original stake may be varied, the player may make their final bet by moving their stake from the ANTE box directly forwards to the appropriate arc 20 in front of them, and/or may indicate their final bet by using a marker rather than actual money. The sequence of events can be varied, eg by the dealer's card being dealt at an earlier stage (although obviously it cannot be exposed until the players have all made their final bets). Also, the table may be provided with raised and/or indented regions as well as or instead of markings, to minimize the chances of stakes or markers being placed in ambiguous positions.

Further, the rules for winning and losing hands may be varied. Thus an Ace, for example, may be defined as either a high card or a low card. In the preferred form of the game, if dealer's card is above 10, it is disregarded and another card is dealt by the dealer, so that in effect, the dealer's card cannot have a value above 10. This limiting value can be varied, and a lower limiting value can be used instead or as well (with a dealer's card below a set level being discarded and another dealer's card dealt). Alternatively, a dealer's card value above and/or below the set limit can be declared an automatic player's win (or loss).

Figure 2:
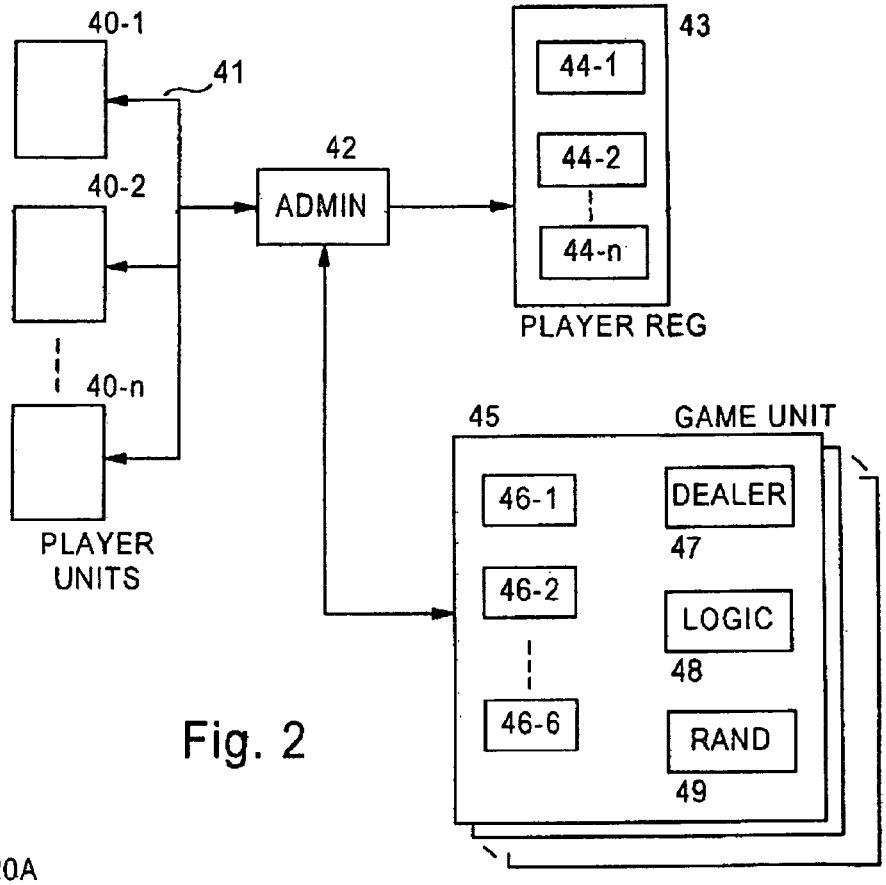
FIG. 2 is a simplified block diagram of computerized apparatus for playing the game.

FIG. 2 shows apparatus for playing the game. There is a plurality of player units 40-1 to 40-n which are coupled via a communication system 41, such as the Internet, with a game playing system comprising an administration unit 42, a player register 43, and a game unit 45. Each unit 40 is typically a personal computer with a display unit and control means (a keyboard and a mouse).

When a player logs on to the game playing system, their unit 40 identifies itself to the administration unit. The system holds the details of the players in the register 43, which contains separate player register units 44-1 to 44-n for all the potential players, ie for all the members of the system.

Once the player has been identified, the player is assigned to a game unit 45. The game unit contains a set of player data units 46-1 to 46-6, a dealer unit 47, a control unit 48, and a random dealing unit 49.

Up to seven players can be assigned to the game unit 45. There can be several such units, as indicated, so that several games can be played at the same time if there are more than seven members of the system logged on at the same time. The assignment of a player unit 40 to a player data unit 46 may be arbitrary or random, depending on which player data units 46 and game units 45 are free. Each player data unit 46 is loaded from the corresponding player register unit 44 and also contains essentially the same details as the corresponding player unit 40, and is in communication with the player unit 40 to keep the contents of the player unit and player data unit updated with each other. In addition, the appropriate parts of the contents of the other player data units 46 and the dealer unit 47 are passed to the player unit 40 for display.

The logic unit 48 of the game unit 45 steps the game unit through the various stages of the play, initiating the dealer actions and awaiting the appropriate responses from the player units 40. The random dealing unit 49 deals cards essentially randomly to the dealer unit 47 and the player data units 46. At the end of the hand, the logic unit passes the results of the hand, ie the wins and/or losses, to the player data units 46 to inform the players of their results. The administrative unit 42 also takes those results and updates the player register units 44 accordingly.

Figure 3:
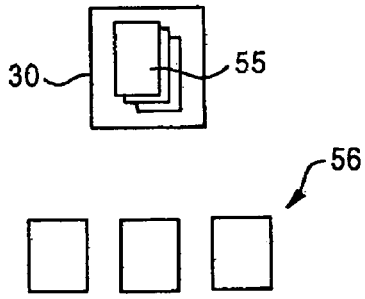
FIG. 3 is a simplified diagram of part of the display of the apparatus.

The player units 40 are arranged to show a display which essentially corresponds to the layout shown in FIG. 1. To identify the player, the player's position is highlighted. As play proceeds, so the player selects the various boxes, enters bets in them, and so on, and the results of those actions are displayed. As the cards are dealt, a series of overlapping card symbols is shown in the Bonus box 22, as indicated at 55 in FIG. 3. At the option of the player, the cards can be shown in a line 56 below the box 22, and similarly for the card dealt to the dealer. At the end of the hand, a message is displayed informing the player of the results of their bets, ie the amounts won or lost.

In the claims, all references in parentheses to technical features are references within the meaning of EPC Rule 29(7), whether the references are to individual features within specific figures or to complete figures, and are not to be taken as implying reliance on those features within the meaning of Rule 29(6).

The invention claimed is:

1. A method of playing a gambling card game by using a deck of playing cards; the method comprising following the sequence of steps of:

a) each player placing an initial bet;

b) a dealer dealing to each player a fixed number of cards;

c) each player inspecting their cards, and deciding whether or not to increase their initial bet by a multiple chosen by the player in dependence on the cards in their hand, player(s) that decide to increase their initial bet, placing an additional bet that is a multiple of that bet;

d) after all players have made their initial bets and additional bets, the dealer dealing a single card to the dealer;

e) if the single dealer's card is above a certain value, discarding the single card and dealing another single card to the dealer;

f) when the single dealer's card is below the certain value, comparing the dealer's card to the player's cards, if any of the cards in the player's hand matches the dealer's card in suit and exceeds the dealer's card in value, the dealer paying out the player's bets.

2. The method according to claim 1 wherein the hands are 3-card hands.

3. The method according to claim 1 wherein each player makes the additional bet, at the same odds as said chosen multiple, if the player's hand consists wholly of court cards.

4. The method of claim 1 wherein the game is played at a game board having one or more player positions arranged around a dealer position.

5. The method of claim 1 wherein the game is played via plurality of player units which are coupled via a communication system with a game playing system.

6. The method according to claim 5 wherein the game playing system comprises an administration unit, a player register, and a game unit.

7. The method according to claim 5 wherein the communication system is the Internet.

8. The method of claim 1 wherein the game is played at a game board having one or more player positions arranged around a dealer position, the game board further comprising: a plurality of arcs arranged around the dealer position and each arc passing through each of the plurality of player positions.

9. The method of claim 8 wherein each arc has a successive multiplier.

* * * * *